United States Patent [19]

Dauvergne

[11] 4,115,883

[45] Sep. 26, 1978

[54] DIAPHRAGM ACTIVATED TOILET

[76] Inventor: Hector A. Dauvergne, P.O. Box 884, San Leandro, Calif. 94577

[21] Appl. No.: 801,521

[22] Filed: May 31, 1977

[51] Int. Cl.[2] ..... E03D 3/10

[52] U.S. Cl. ..... 4/353; 4/362; 4/387; 4/424; 4/426

[58] Field of Search ..... 4/10, 12–15, 4/18, 26, 353, 354, 361, 362, 368, 378, 387, 392, 393, 405, 411, 424, 426, 438, 439, 441

[56] References Cited

U.S. PATENT DOCUMENTS

| | | | |
|---|---|---|---|
| 3,029,443 | 4/1962 | Naccarato | 4/26 |
| 3,234,565 | 2/1966 | Stott | 4/15 |

*Primary Examiner*—Richard E. Aegerter
*Assistant Examiner*—Frederick R. Schmidt
*Attorney, Agent, or Firm*—Bielen and Peterson

[57] ABSTRACT

A toilet for conserving water, the toilet having a water storage chamber which includes an expandable diaphragm wall that on filling under household water supply pressure conforms to a wall of a complimentary air chamber separated from the storage compartment by the diaphragm. The chamber communicating with a gated discharge cavity between a trap and a sewage line, wherein water in the storage compartment is released at a high flow rate into a bowl having sedentary waste water, the waste water being exhausted from the bowl into the discharge cavity by a partial vacuum action generated by the contracting diaphragm concurrent with the introduction of the supply water, the waste water being gated from the discharge cavity into the sewer line on reduction of the vacuum pressure, whereby the supply water replaces rather than flushes the waste water.

4 Claims, 2 Drawing Figures

DIAPHRAGM ACTIVATED TOILET

BACKGROUND OF THE INVENTION

This invention relates to the field of water closets with combined tank and bowl having an alternate flushing means. In particular, the invention is devised to conserve water by replacing rather than flushing the sedentary waste water in the bowl of the toilet.

In prior art devices a toilet has required a large volume of water to thoroughly flush the relatively small amount of waste water in the bowl of the toilet. This extravagent use of water may once have been justified, but with the present recognition of water as a scarce as well as valuable commodity, such use can no longer be continued without concern. Conservation steps to mitigate the unnecessarily large volume of water used during flushing, customarily 4 to 6 gallons, have consisted largely of reducing the volume of water in the accompanying toilet storage tanks by placing therein bricks or filled bottles as water displacement devices or lowering the float position for the water intake valve. These measures may reduce the loss by as much as a gallon, but are limited by the inherent design requirements of the flush toilet which prevents too great a reduction a volume if consistent operability is to be maintained.

Other toilet designs utilizing chemicals or recycled mineral oils can substantially reduce water consumption but are better suited for environments where water is virtually unavailable. For the common situation where water is available, a toilet system designed with water as the medium of waste conveyance is preferred. However, the system should necessarily be designed to use water sparingly. The toilet of the invention is devised to minimize the use of water, yet retain many characteristics of the conventional flush toilet.

SUMMARY OF THE INVENTION

The devised toilet of the invention operates on a replacement principle rather than the flush principle of conventional water toilets. In this invention, momentarily before the new water is introduced, the sedentary waste water is evacuated from the bowl in such a manner that there is a minimum mix of the introduced water, and a minimum loss of the introduced water into the drainage system.

This objective is achieved by employing an elastomeric diaphragm separating an air chamber which is concomitant to a water supply chamber. An expansion of the water supply chamber by deformation of the diaphram on filling with water from a pressurized supply, the air chamber is simultaneously reduced. The air chamber communicates with a lower line cavity located between the sewage line and a conventional water trap component of the toilet bowl. The lower line cavity is gated with a flap valve such that when supply water is suddenly introduced into the upper area of the bowl under the pressure of the contracting diaphram, the sedentary waste water is evacuated from the bowl by the partial vacuum suction created on the air chamber side of the diaphram. The partial vacuum maintains the flap valve closed until the waste water is substantially drawn into the line cavity. The weight of the water coupled in part with a brief pressure relief on withdrawing the water from the bowl causes the flap to open releasing the waste water into the sewage line. At almost the same time that the waste water is scavenged from the bowl, the water from the water supply introduced into the upper portion of the bowl swirls to the lower bowl where only the initial portion is lost with the scavenged waste water. At the most, for optimum design the volume of water introduced should be no more than twice the volume of the water scavenged, and preferably is approximately one and one half times the scavenged water.

DETAILED DESCRIPTION OF THE PREFERRED EMBODIMENT

Figure 1:
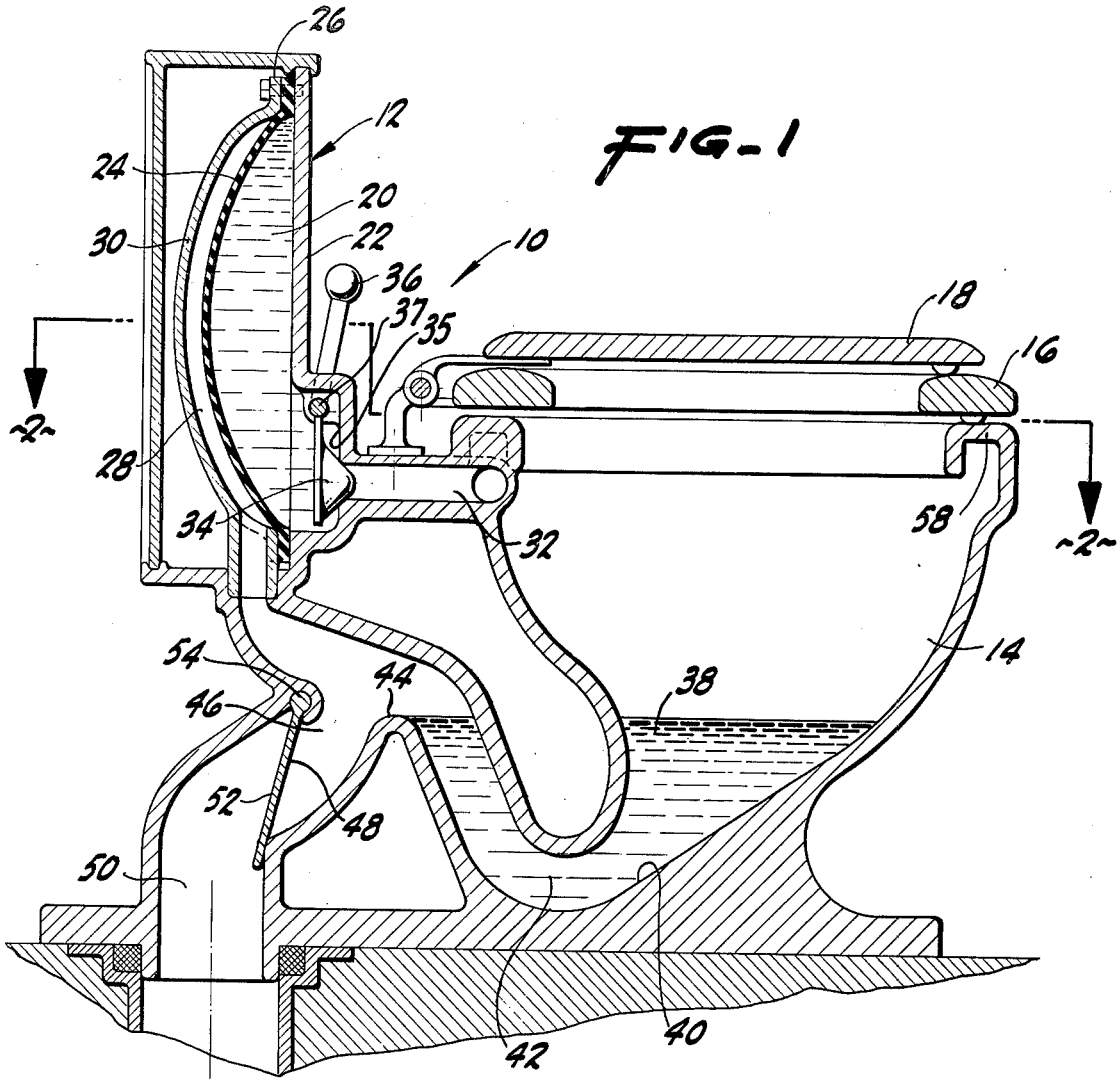
FIG. 1 is a cross sectional view of the toilet.

Referring to FIG. 1, a toilet designated generally by the reference numeral 10, is shown with a configuration similar to that of a conventional toilet. The toilet 10 has a water storage tank 12 holding a supply of dischargeable water connected to a bowl 14 holding a sedentary quantity of water in a manner similar to conventional toilets. The bowl 12 is capped by a customary seat 16 and a cover 18 for normal household use. While externally similar, the toilet shown operates in a wholly different manner than the usual flush toilet.

Referring to the cross sectional view of the toilet in FIG. 1, the distinguishing features of the devised water saving toilet are illustrated. The water supply is contained in a supply chamber 20 defined by the front wall 22 of the storage tank and an elastomeric diaphragm 24. The diaphragm is appropriately sealed by an adhesive and compressing rim 26 fastened to the front wall of the tank. Behind the diaphragm 24 is an air chamber 28 which is defined by the diaphragm 24 and an inner tank wall 30 having substantially a partial spherical configuration. In FIG. 1, the air chamber 28 is substantially evacuated by the position of the diaphragm 24 which is almost fully expanded from the supply of water in the supply chamber. Essentially, both the air chamber and water chamber are variable in volume and are defined by the overall cavity in the storage tank formed by the front wall 22 and the inner wall 30 as divided by the expandable and contractable diaphragm 24.

Connected to the front wall 22 of the storage tank 12 is a discharge conduit 32 through which the supply water is discharged to the top of the toilet bowl 14 upon opening of a flap valve 34. The flap valve 34 is mounted in a recess 35 in the front wall 22 and is manually operated by a hand crank 36 rigidly connected to the flap valve and pivotal on a common pivot axis 37.

In the bowl 14 sedentary water 38 is maintained at a constant level in the bowl 14 by a waste line 40 having a trap 42 with an overspill 44. The overspill portion of the waste line 40 leads to a temporary holding cavity 46 which communicates with the air chamber 28, and on opening of a gate 48, with the sewage line 50. The gate 48 comprises a gravity closable flap 52 connected to a pivot 54.

Figure 2:
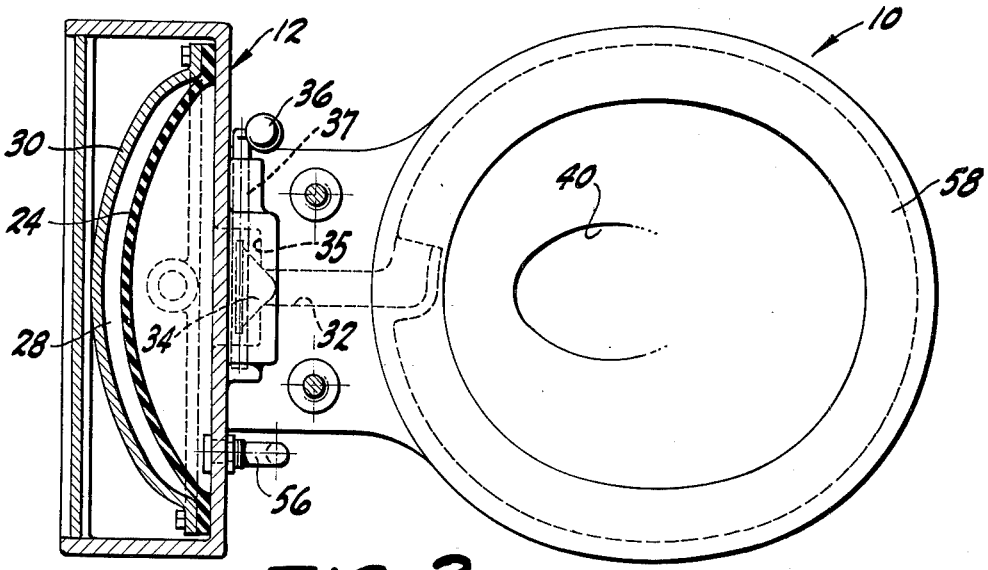
FIG. 2 is a cross sectional view of the toilet taken on the lines 2—2 in FIG. 1.

Referring also to FIG. 2, when water from a supply source such as a household water supply is fed to the supply chamber through a check valve 56 at the front wall 22 of the tank 12, the diaphragm 24 expands until it conforms to the inner tank wall 30. On opening the flap valve 34 to the discharge conduit 32, water from the supply chamber surges into the upper part of the toilet bowl through the conduit 32 under force of the contracting diaphragm.

The conduit 32 is directed horizontally under the top lid 58 of the bowl both for cleansing action and for the short delay in the water reaching the lower bowl by the swirling action of the discharge. Concurrently with the reduction in volume of the water supply chamber 20, the air chamber expands. The expansion in the air chamber creates a partial vacuum in the cavity which maintains the gate 48 closed and draws the sedentary waste water over the overspill and into the cavity. When nearly all the waste water is in the cavity the weight of the water opens the flap 52 of the gate 48, mounted in the discharge passage 60, releasing the water into the sewage line along with a small initial portion of the supply water which has reached the bowl. When all of the water has been discharged and the diaphragm 24 is contracted across the front wall 22, the supply chamber is gradually refilled and the diaphragm expanded by pressure of the water in the household supply.

What is claimed is:

1. A water saving toilet device comprising:

a bowl constructed to hold a quantity of sedentary water and waste;

a first cavity having a flexible diaphragm wherein said flexible diaphragm divides said first cavity into a water storage chamber having a variable volume on one side of said diaphragm and an air chamber having a variable volume on the other side of said chamber;

means for deforming said diaphragm, increasing the volume of the water storage chamber and diminishing the volume of the air chamber;

discharge means communicating with said water storage chamber for initiating a discharge of a stored quantity of water from said storage means to said bowl when said discharge means is activated;

a trap means communicating with said bowl for maintaining a predetermined quantity of sedentary water in said bowl;

a second cavity communicating with said trap means for temporarily holding a quantity of water evacuated from said bowl, said second cavity having release means for releasing water held in said cavity to a conventional sewer line; and, draw means comprising an air passage between said air chamber and said second cavity for drawing sedentary water in said bowl and trap means into said second cavity; wherein said discharge means, when activated, reverses the action of said deforming means, decreasing the volume of the water storage chamber and increasing the volume of the air chamber, generating a partial vacuum in said second cavity.

2. The toilet device of claim 1 wherein said release means of said second cavity includes means for maintaining a partial vacuum in said cavity during at least a portion of the discharge of water from said water storage chamber.

3. The toilet device of claim 2 wherein said release means comprises a discharge passage and said means for maintaining a partial vacuum in said second cavity comprises a flap valve arranged in said discharge passage with a flap suspended in said passage and positioned for gravity closure, said valve being opened by water from said bowl and trap means.

4. The toilet of claim 3 wherein said discharge means comprises a flap valve pivotally connected to said water storage chamber, said flap valve having handle means projecting externally of said storage chamber for manual operation of said discharge means.

* * * * *